US011224268B2

(12) United States Patent
Berger

(10) Patent No.: US 11,224,268 B2
(45) Date of Patent: Jan. 18, 2022

(54) DUAL BAND SPINNER RING

(71) Applicant: Jason Gabriel Berger, Huntington Beach, CA (US)

(72) Inventor: Jason Gabriel Berger, Huntington Beach, CA (US)

( * ) Notice: Subject to any disclaimer, the term of this patent is extended or adjusted under 35 U.S.C. 154(b) by 0 days.

(21) Appl. No.: 16/827,561

(22) Filed: Mar. 23, 2020

(65) Prior Publication Data

US 2021/0289896 A1 Sep. 23, 2021

(51) Int. Cl.
*A44C 9/00* (2006.01)
*A63H 1/00* (2019.01)

(52) U.S. Cl.
CPC ..... *A44C 9/003* (2013.01); *A63H 1/00* (2013.01)

(58) Field of Classification Search
CPC ..... A44C 9/003; A44C 5/0092; A63H 1/00
USPC ..... 63/15
See application file for complete search history.

(56) References Cited

U.S. PATENT DOCUMENTS

| | | | | |
|---|---|---|---|---|
| 1,558,418 | A | 10/1925 | Bertil | |
| 1,712,417 | A * | 5/1929 | Beaujard, Jr. | A44C 9/003 63/15.3 |
| 2,060,345 | A * | 11/1936 | Phillips | A44C 9/003 63/3 |
| 2,185,811 | A | 8/1939 | Nathan | |
| 2,497,207 | A | 2/1950 | Ernest | |
| 5,228,316 | A | 7/1993 | Meyrowitz | |
| 5,591,062 | A | 1/1997 | Hettinger | |
| 5,669,240 | A | 9/1997 | Lima | |
| 5,678,428 | A | 10/1997 | Pasquetti | |
| 6,065,971 | A | 5/2000 | Lennon | |
| 6,574,989 | B1 * | 6/2003 | Lampert | A44C 9/003 63/15 |
| 8,636,624 | B2 | 1/2014 | Liberman | |
| 9,445,652 | B1 | 9/2016 | Yousef | |
| D813,077 | S | 3/2018 | Noble | |
| 9,914,063 | B1 | 3/2018 | Mccoskery | |
| 2001/0020369 | A1 | 9/2001 | Hirano | |
| 2008/0314081 | A1 | 12/2008 | Morgan et al. | |
| 2011/0011131 | A1 | 1/2011 | Bisserier | |
| 2019/0015757 | A1 | 1/2019 | Mak | |
| 2019/0174885 | A1 * | 6/2019 | Tata | A44C 9/003 |

FOREIGN PATENT DOCUMENTS

| | | | | |
|---|---|---|---|---|
| CN | 205337879 | U * | 6/2016 | |
| DE | 9413057 | U1 * | 10/1994 | A44C 9/003 |
| DE | 2013100000436 | B4 | 12/2014 | |
| JP | 4172675 | B2 | 10/2008 | |
| KR | 20110085685 | A * | 7/2011 | |

OTHER PUBLICATIONS

Https://www.instructables.com/id/Spinner-Ring-Copper-Silver/.
Http://www.fundamentals.net/blog/2014/05/30/daisy-spinner-ring-tutorial/.
Https://www.erindelargy.com/blog/the-making-of-a-spinner-ring/.

* cited by examiner

*Primary Examiner* — Jack W Lavinder

(57) ABSTRACT

A ring comprised of two interlinked bands not fused together, an inner band 101 and an outer band 102. This arrangement allows the outer band 102 to revolve around the inner band 101 without separating. Other embodiments of this method are described and shown.

3 Claims, 4 Drawing Sheets

DUAL BAND SPINNER RING

BACKGROUND—PRIOR ART

The following is a tabulation of some prior art that presently appears relevant:

U.S. Patents

| Patent Number | Kind Code | Issue Date | Patentee |
|---|---|---|---|
| 1,558,418 | A | 1925 Oct. 20 | Bertil |
| 2,185,811 | A | 1939 Aug. 31 | Nathan |
| 2,497,207 | A | 1950 Feb. 14 | Ernest |
| 5,228,316 | A | 1993 Jul. 20 | Meyrowitz |
| 5,591,062 | A | 1997 Jan. 07 | Hettinger |
| 5,669,240 | A | 1997 Sep. 23 | Lima |
| 5,678,428 | A | 1997 Oct. 21 | Pasquetti |
| 6,065,971 | A | 2000 May 23 | Lennon |
| 6,085,122 | A | 2000 Jul. 04 | Manning |
| 6,215,093 | B1 | 2001 Apr. 10 | Meiners, et al |
| 8,636,624 | B2 | 2014 Jan. 28 | Liberman, Hopson |
| 9,445,652 | B1 | 2016 Sep. 20 | Yousef |
| 9,914,063 | B1 | 2018 Mar. 13 | McCoskery |
| D813077 | S1 | 2018 Mar. 20 | Noble |

U.S. Patent Application Publications

| Publication Nr. | Kind Code | Publ. Date | Applicant |
|---|---|---|---|
| 20010020369 | A1 | 2001 Sep. 13 | Hirano |
| 20080314081 | A1 | 2008 Dec. 25 | Morgan, et al. |
| 20110011131 | A1 | 2011 Jan. 20 | Bisserier |
| 20190015757 | A1 | 2019 Jan. 17 | Bumblebee Studio Ltd |

Foreign Patent Documents

| Foreign Doc. Nr. | Cntry Code | Kind Code | Pub. Dt | App or Patentee |
|---|---|---|---|---|
| 4172675 | JP | B2 | 2008 Oct. 29 | Uchida |
| 2013100000436 | DE | B4 | 2014 Dec. 18 | Heinz |

NONPATENT LITERATURE DOCUMENTS https://www.instructables.com/id/Spinner-Ring-Copper-Silver/ http://www.fundametals.net/blog/2014/05/30/daisy-spinner-ring-tutorial/ https://www.erindelargy.com/blog/the-making-of-a-spinner-ring/

A spinning toy, commonly referred to as "fidget spinner," is essentially a device comprised of a circular center piece to grip, while an outer piece, loosely restrained to this center piece, spins coaxially around this center piece. This device is small enough to fit in a hand to be gripped by the thumb and index or middle finger while the outer piece spins between these two digits. U.S. Pat. No. 5,591,062 of Hettinger, U.S. Pat. No. 9,914,063 of McCoskery, and U.S. Pat. Application No. 20190015757 of Bumblebee Studio Ltd. illustrates such a device. Although the toy has proven to be popular, due in part to the soothing psychological effect it has on the person spinning it, it is somewhat inconvenient; it can be bothersome to carry, and to use such a device in social and professional engagements can be overly distracting to the people interacting with the person spinning the device.

Spinner rings, commonly referred to as "fidget rings," are wearable, less conspicuous devices with a similar function and effect. A spinner ring constitutes two bands, in which the inner band restrains a second outer band by two annular protrusions or rims at the top and bottom. This arrangements allows the outer band to spin coaxially around the inner band. At present, we can categorize two kinds of spinner rings as seen in the market, claimed in patents, or shown in fabrication tutorials: those in which the two bands are individual pieces, and those in which at least one of the two bands comprises of two or more parts.

The spinner rings of individual pieces are made somewhat crudely, either by flaring the edges of an inner band with a hammer (see https://www.instructables.com/id/Spinner-Ring-Copper-Silver/), or bending and/or soldering the outer band around the inner band (see http://www.fundametals.net/blog/2014/05/30/daisy-spinner-ring-tutorial/ and https://www.erindelargy.com/blog/the-making-of-a-spinner-ring/).

Both crude techniques produce an inferior ring. The imprecise nature of fabrication consequently forms a large gap of the space between the inner circumference of the outer band to the inner band's outer circumference, resulting in the outer band to shake and jingle when worn. Also, the bending of metal compromises the structural integrity of the bent band, and there exists a high likelihood of accidentally warping or disfiguring any design or overall form on the band being hammered or soldered on.

Furthermore, to compensate for the dual band ring's compromised structural integrity, a jeweler would have to increase the thickness of a band, resulting in a bulky ring, uncomfortable to wear on a finger.

The spinner rings of three or more parts are assembled together in a sequence specific to the ring's design. The jeweler then secures the bands of the ring together by either soldering or gluing, as seen in U.S. Pat. No. 5,678,428 of Pasquetti and U.S. Pat. Application No. 20110011131 of Bisserier, fastening the parts together with threads inherent to the design to screw into each other, as seen in U.S. Pat. No. 5,228,316 of Meyrowitz, inserting screws or rods to hold the band together, as seen in U.S. Pat. No. 8,636,624 of Liberman and Hopson, or interlinking or latching the parts onto one another, as seen in Foreign Pat. No. DE2013100000436 of Heinz or U.S. Pat. Application No. 20010020369 of Hirano.

The characteristic of a ring having multiple parts fastened, glued, or held together by some means runs the risk of becoming loose or detached from one another, particularly for an object that is being fidgeted with on a daily basis. If the ring's parts do detach these parts could become lost, or could cause the whole ring to fall off the wearer's finger. Furthermore, the mere thought that a ring could come apart because a fastener came loose or dissolved over time can give its wearer a kind of anxiety, which negates the soothing purpose of the spinner ring.

Although the results of this category of spinner rings are more precise by avoiding the necessity of bending or contorting a band to achieve the desired arrangement, they must have a certain thickness in order to fasten the divided band's parts together. This necessity causes it to have the same issue of bulkiness and discomfort that the rings of two individual bands do.

Until recently, jewelry was only manufactured using the lost-wax casting method or by forming material using bending, contorting, or cutting techniques. More 3-dimensional (3D) printing techniques have become more affordable and accessible due to the expiration of patents, particularly U.S.

Pat. No. 6,085,122 by Manning entitled "End-of-Vector Laser Power Control in a Selective Laser Sintering System," which expired 2017 May 30, and U.S. Pat. No. 6,215,093 by Meiners et al. entitled "Selective Laser Sintering at Melting Temperature," which expired 2017 Oct. 27. The expiration of these patents is creating a greater supply of metal 3D printers in the market, including laser-sintering and laser-melting printers. This offers more opportunities for end-product design and manufacturing using these printers.

SUMMARY OF THE INVENTION

The objective of this invention is to fabricate a ring that has two bands, wherein one band is securely interlinked around the other seamlessly, designed to permit one band to revolve around the other. This assembly is accomplished not by the bending or contorting of one band around another, but by the complete and simultaneous materialization of one band around the other. To interlink the two bands, annular channels and protrusions on the complementary sides of the bands prevent separation.

DETAILED DESCRIPTION

FIGS. 1-4—First Embodiment

Figure 1:
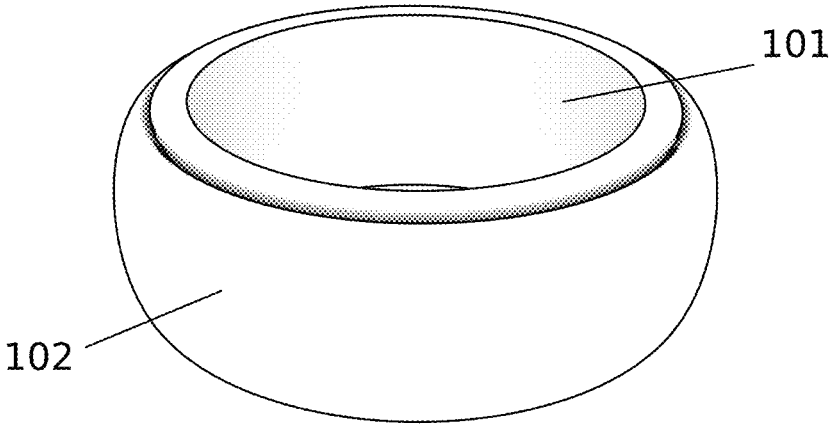
FIG. 1 is a perspective view of a first embodiment.
Figure 2:
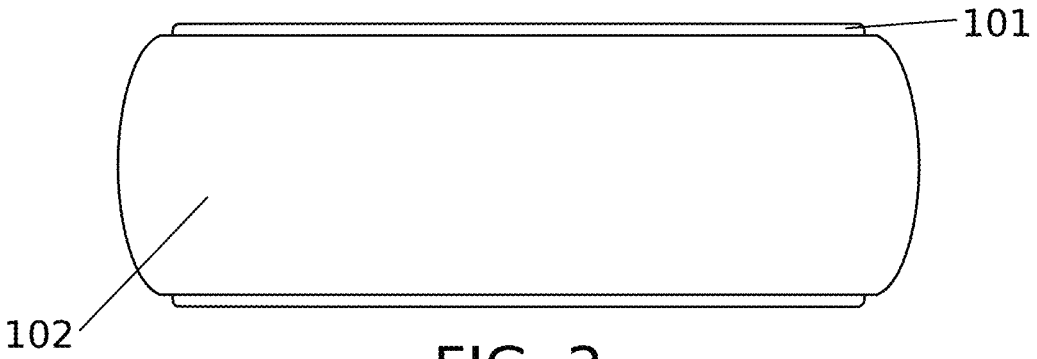
FIG. 2 is a side view of the embodiment of FIG. 1.

FIGS. 1 and 2 show an embodiment of a ring with two bands, an inner band 101 and an outer band 102.

Figure 3:
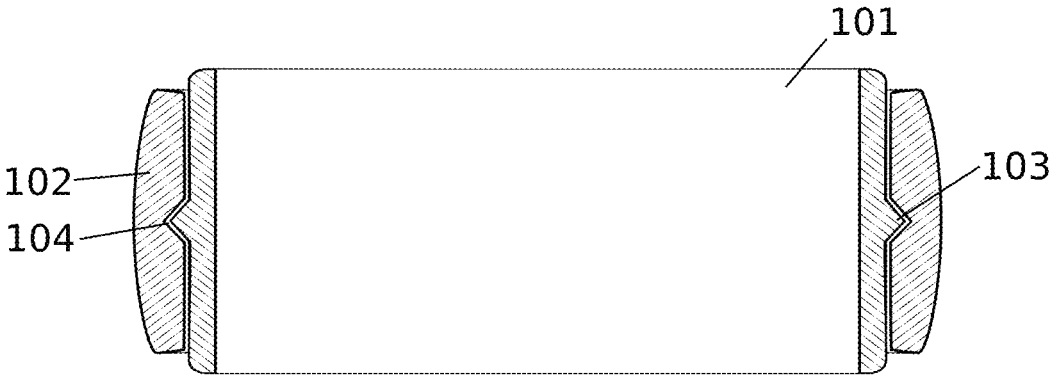
FIG. 3 is a cross-sectional side view of the embodiment of FIG. 1.
Figure 4:
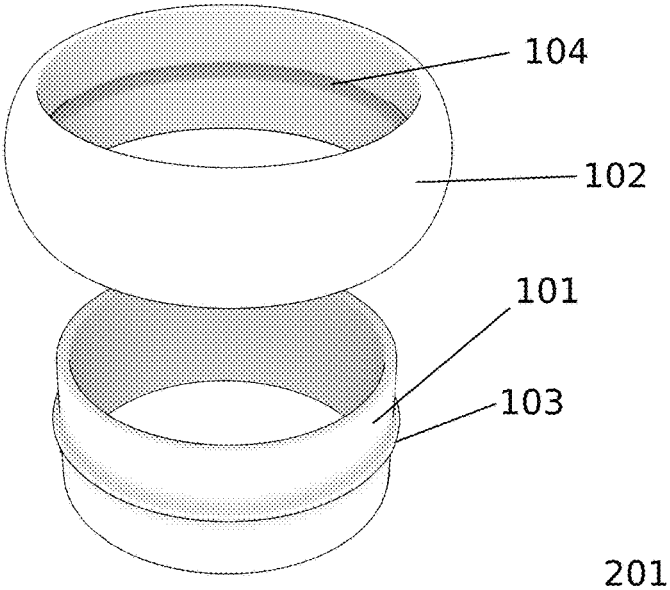
FIG. 4 is an exploded perspective view of the embodiment of FIG. 1.

FIGS. 3 and 4 show the inner band 101 with an annular protrusion 103 and outer band 102 with a complementary annular channel 104. Both the protrusion 103 and the channel 104 are inherent in their original materialized designs. The protrusion 103 and the annular channel 104 have two 45° angle inclines in relation to the bottom of the ring. There is a gap between the inner band 101 and the outer band 102, there is no fusion between them.

DETAILED DESCRIPTION

Figure 5:
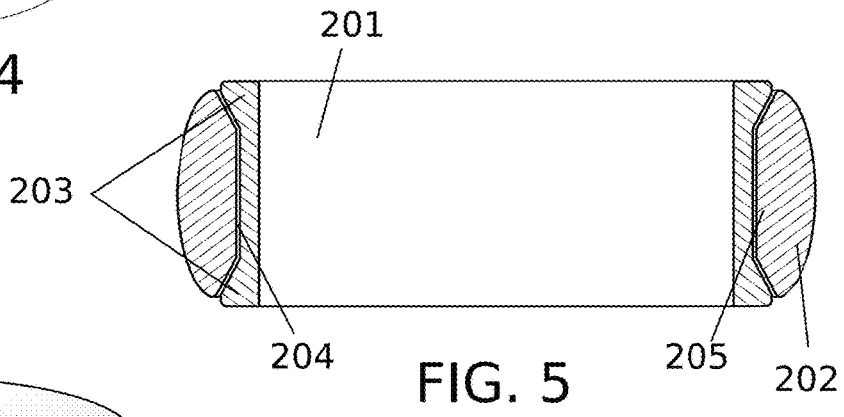
FIG. 5 is a cross-sectional side view of a second embodiment.
Figure 6:
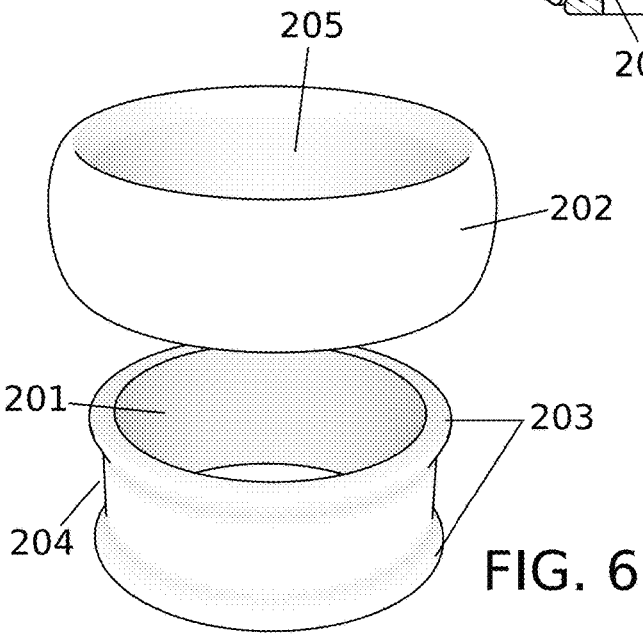
FIG. 6 is an exploded perspective view of the embodiment of FIG. 5.

FIGS. 5, 6—Second Embodiment

FIGS. 5 and 6 show a second embodiment of a ring with two bands, an inner band 201 and an outer band 202. The inner band 201, inherent in its original materialized design, has two annular protrusions 203 or lips to form an annular channel 204. The outer band 202, also inherent in its original materialized design, has an annular protrusion 205, complementary to the channel 204. Both the annular protrusions 203 (and consequently the channel 204) and the annular protrusion 205 have a 60° angle incline in relation to the bottom of the ring. There is a gap between the inner band 201 and the outer band 202, there is no fusion between them.

Figure 7:
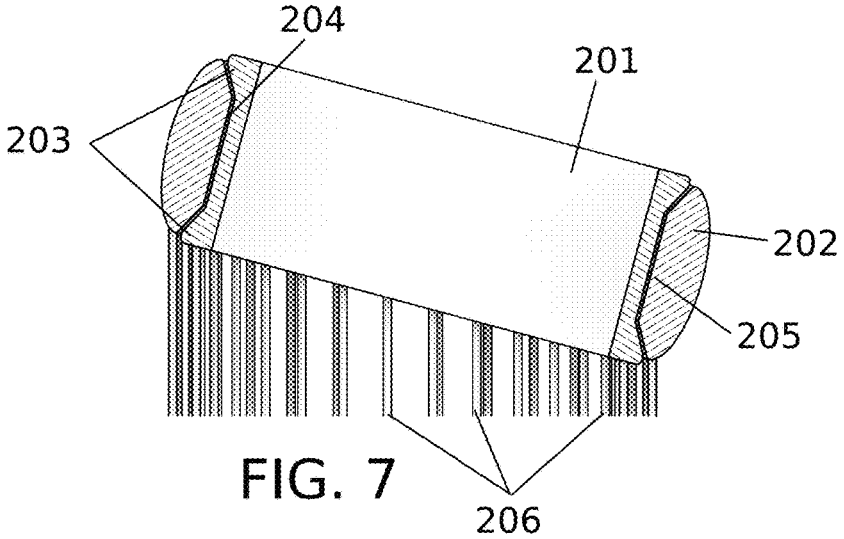
FIG. 7 is a cross-sectional side view of the embodiment of FIG. 5 on supports.
Figure 8:
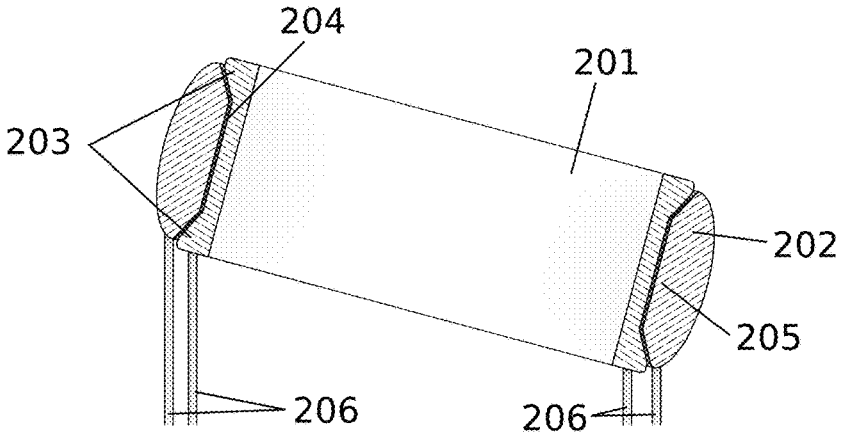
FIG. 8 is a cross-sectional side view of the embodiment of FIG. 5 on the four supports closest to the cross-section plane.
Figure 9:
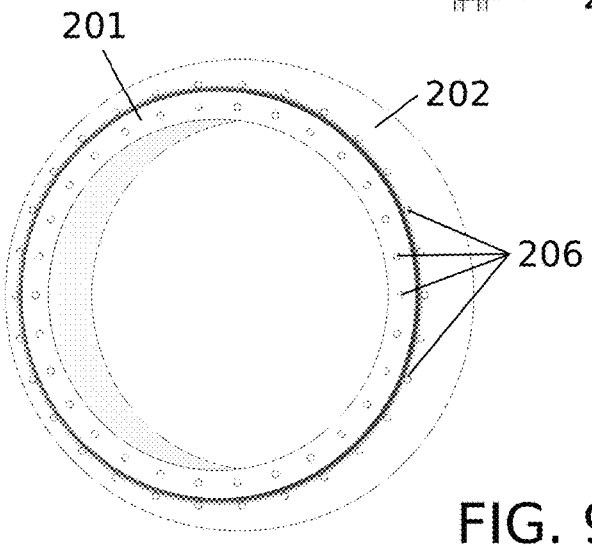
FIG. 9 is a bottom view of the embodiment of FIG. 5 on 3D printing supports.

FIGS. 7, 8, and 9 show the second embodiment's inner band 201 and outer band 202 tilted at a 10° angle relative to the horizontal with supports 206 as an example of how both embodiments would be printed in a 3D printer. FIG. 8 shows only the supports 206 closest to the section-plane to demonstrate how the inner band 201 and the outer band 202 can be printed as two separate units.

DETAILED DESCRIPTION

Figure 10:
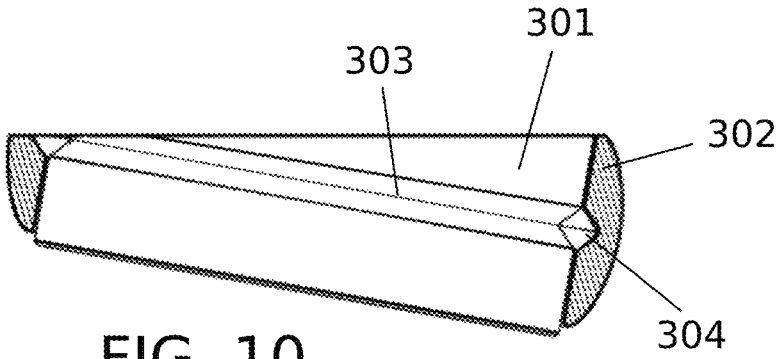
FIG. 10 is a cross-sectional side view of a third embodiment, partially completed.
Figure 11:
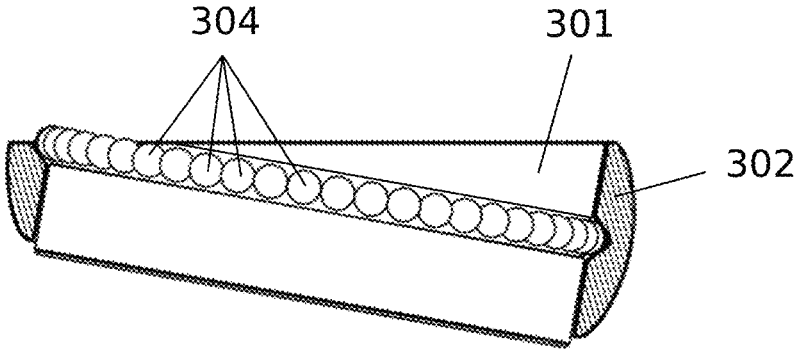
FIG. 11 is a cross-sectional side view of a FIG. 10 with ball bearings, partially completed.
Figure 12:
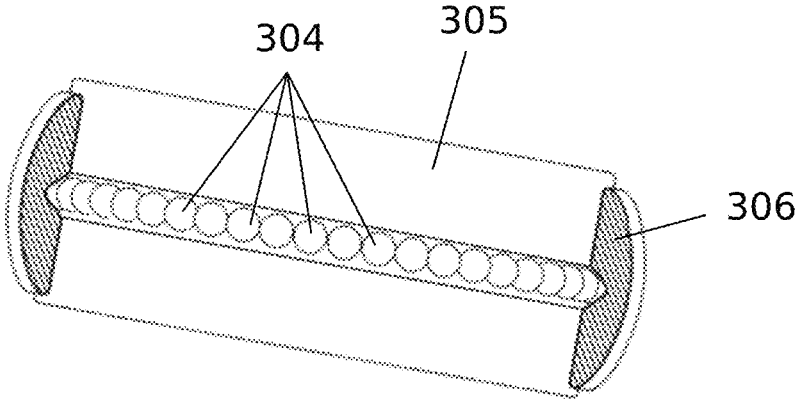
FIG. 12 is a cross-sectional side view of FIG. 10 with ball bearings, after materialization is complete.

FIGS. 10, 11, 12—Third Embodiment

FIG. 10 shows a third embodiment of a ring with two bands, a partially materialized inner band 301 and a partially materialized outer band 302. The inner band 301 has an annular channel 303, which is aligned to an annular channel 304 of the outer band 302. Both the annular channels 303 and 304 have at most 60° angle inclines in relation to the bottom of the ring. FIG. 11 shows a plurality of ball bearings 305 inserted into the aligned channels 303 and 304. The materization of the ring then continues, FIG. 12 shows the bearings 305 now trapped between a completed inner band 305 and a completed outer band 306.

A Method of Fabrication

FIGS. 1-4—First Embodiment

In order to process the materialization of the outer band 102 around the inner band 101, this embodiment will be 3D printed using the laser-sintering or laser-melting methods, and so its design must respect the tolerances of the printer that relate to the necessity of using support material for overhanging surfaces. Typically, a printer has a tolerance of about 30° relative to the horizontal that can materialize an ascending protruding layer without the need of support material. Therefore, the protrusion's 103 and channel's 104 protruding inclines will be able to print without the need for supports.

Printer manufacturers recommend that any object be tilted about 10° to avoid printing defects along the bottom surface. If the bands 101 and 102 are tilted 10° in preparation for printing, then the bands' inclines and declines have a 35° angle to the horizontal within the recommended minimum 30° tolerance of the printer. After the ring is materialized, all support material is removed and discarded. In its finished stage, the inner band 101 and outer band 102 will be securely interlinked together by the design of the inner band's 101 annular protrusion 103 and the complementary design of the outer band's 102 annular channel 104, but allowing the outer band 102 to revolve around the inner band 101, as the inner band 101 and outer band 102 are not fused together.

A Method of Fabrication

FIGS. 5-9—Second Embodiment

In order to process the materialization of this embodiment, printer angle tolerances have been considered for this embodiment as well. Tilting the inner band 201 and outer band 202 10° for printing recommendations will keep the rings within the 30° overhang tolerance of the printer. Supports will not be necessary for any overhangs, thus being able to print the inner band 201 and outer band 202 simultaneously with the inner band 201 inside the outer band 202 as depicted in FIG. 7, thus avoiding the need to bend or fasten one band to the other post-materialization. The supports 206 that are attached to the bottom of the inner band 201 and outer band 202 are to be removed and discarded. In its finished stage, the inner band 201 and outer band 202 will be securely interlinked together by the design of the inner band's 201 annular protrusions 203, the resulting channel 204 of said protrusions, and the complementary design of the outer band's 202 annular protrusion 205, but allowing the outer band 202 to revolve around the inner band 201, as the inner band 201 and outer band 202 are not fused together.

CONCLUSIONS, RAMIFICATIONS, AND SCOPE

The reader will see that each embodiment described above achieves the main goals of the invention, that is, to make a spinner ring of two bands that are materialized simultaneously, in an interlinked formation, thus avoiding the need to bend or fasten the bands together, which could lead to a compromised integrity of the material or its assembly. As no bending nor seaming of the ring is necessary in its construction, any motifs drafted on the ring in its design phase will have no risk of being warped or disturbed in that process, and the bands do not need to be uncomfortably thick.

For accuracy and in order to print a ring on a 3D printer, its model must be designed on the computer. There will be no alteration of its design post-printing for the purpose of producing the interlinking or spinning functions.

As for the embodiments' materials, the bands can be made with any material that a 3D printer can print with. Most commercial laser-sintering and laser-melting systems use powdered materials like aluminum, stainless steel, and titanium, and there are several printers that use precious metals, such as gold, silver, and platinum. Although rings made of resin or plastic may have a shorter life span due to the destructive warmth of body heat, stereolithography printers can make these rings. It is conceivable that one can use the resulting resin or plastic-based rings to make metal rings using the lost-wax metal casting method.

While my above descriptions contain many specifics, they should not be construed as limitations on the scope, but rather as an exemplification of several embodiments thereof. Many other variations are possible. For example, both embodiments are designed with protrusions 103 and 203 that wrap along the entire band. The form of these protrusions do not have to wrap along the entire band, but can be substituted by tabs, blocks, or bars of protrusions, that are positioned along the circumference of the band like a dashed or dotted line within its complementary channel of the other band, strategically positioned to prevent the bands from separating.

Another possible variation of the embodiments is to design either the inner bands 101 and 201, or outer bands 102 and 202 with cavities that penetrate from the outer surface of the ring to the inside surface. The existence of such cavities could consequently allow any protrusions in the gap between the bands to have an overhang with supports, as the jeweler now has access to the gap between the two bands and could remove the supports through the cavities.

Accordingly, the scope of the invention should be determined not by the embodiments illustrated, but by the appended claims and their legal equivalents.

I claim:

1. A ring comprising of:

a. a solid, unitary inner band b. a solid, unitary outer band c. a restriction means for preventing said outer band and said inner band to separate, yet allowing said outer band to revolve around said inner band, which does not require either said inner band nor said outer band to be forcibly contorted whereby said outer band can rotate around said inner band freely, and neither the inner band nor outer band have any seams that may affect the continuity of either the inner band or the outer band.

2. The ring of claim 1, wherein said restriction means includes a plurality of round members placed between said inner band and said outer band.

3. The ring of claim 1, wherein the ring is composed of at least one of the following materials: precious metal, base metal, alloy metal, resin, PVC, ABS, PLA, polypropylene, and polycarbonate.

* * * * *